United States Patent [19]

Buik et al.

[11] 4,310,968

[45] Jan. 19, 1982

[54] SHAVING APPARATUS

[75] Inventors: Dirk A. Buik; Eduard W. Tietjens, both of Drachten, Netherlands

[73] Assignee: U.S. Philips Corporation, New York, N.Y.

[21] Appl. No.: 141,735

[22] Filed: Apr. 18, 1980

[30] Foreign Application Priority Data

Feb. 13, 1980 [NL] Netherlands ..... 8000884

[51] Int. Cl.[3] ..... B26B 19/42

[52] U.S. Cl. ..... 30/34.2

[58] Field of Search ..... 30/34.2; 24/204

[56] References Cited

U.S. PATENT DOCUMENTS

| | | | |
|---|---|---|---|
| 2,711,015 | 6/1955 | Scully | 30/34 |
| 2,711,582 | 6/1955 | Scully | 30/34 |
| 2,718,694 | 9/1955 | Scully | 30/34 |
| 2,852,845 | 9/1958 | Scully | 30/34.2 |
| 3,811,188 | 5/1974 | Brenneman | 30/34.2 |
| 4,142,565 | 3/1979 | Plunkett | 24/204 |
| 4,189,832 | 2/1980 | Harper et al. | 30/34.2 |

*Primary Examiner*—Jimmy C. Peters

*Attorney, Agent, or Firm*—Thomas A. Briody; William J. Streeter; Rolf E. Schneider

[57] ABSTRACT

There is provided a shaving apparatus including a holder formed with a planar surface having at least two circular apertures. A circular shear plate having hair-entrance apertures is positioned in each circular aperture, and a cutting unit is rotatably associated with each shear plate. A mat covering the planar surface has circular openings respectively corresponding to the circular apertures. The mat is formed from a strip material provided with bristles, which extend outwardly with respect to the planar surface and the outer ends of which are hook-shaped for straightening hairs prior to their engagement by the hair-entrance apertures.

6 Claims, 6 Drawing Figures

SHAVING APPARATUS

This invention relates to a shaving apparatus having at least one cutting element, which apparatus is provided with a brush for straightening the hairs to be shaved.

Such a shaving apparatus is for example known from British Pat. No. 731,123. The brush serves to straighten bent hairs or hairs which lie flat against the skin as the shaving apparatus is passed over the skin, so that said hairs can more readily be severed by the cutting element.

It is the object of the present invention to improve the effect of the brush. The relevant construction is characterized in that the brush is provided with bristles having hook-shaped ends.

A special embodiment is characterized in that the bristles take the form of loops of which one of the limbs has been severed.

Another special embodiment is characterized in that the hook-shaped ends are formed by plastic deformation of the ends of the bristles.

The brush may constitute a separate component, but may also be integrated with the wall of the shaving apparatus.

A special embodiment comprises a shaving apparatus driven by an electric motor and having a plurality of shaving heads, each shaving head being constituted by a driven element and a non-driven cutting element, the brush being arranged both around and between the shaving heads.

The invention is also embodied in a brush for use in conjunction with such a shaving apparatus which brush constitutes a separate component, its bristles being formed with hook-shaped ends.

Figure 1:
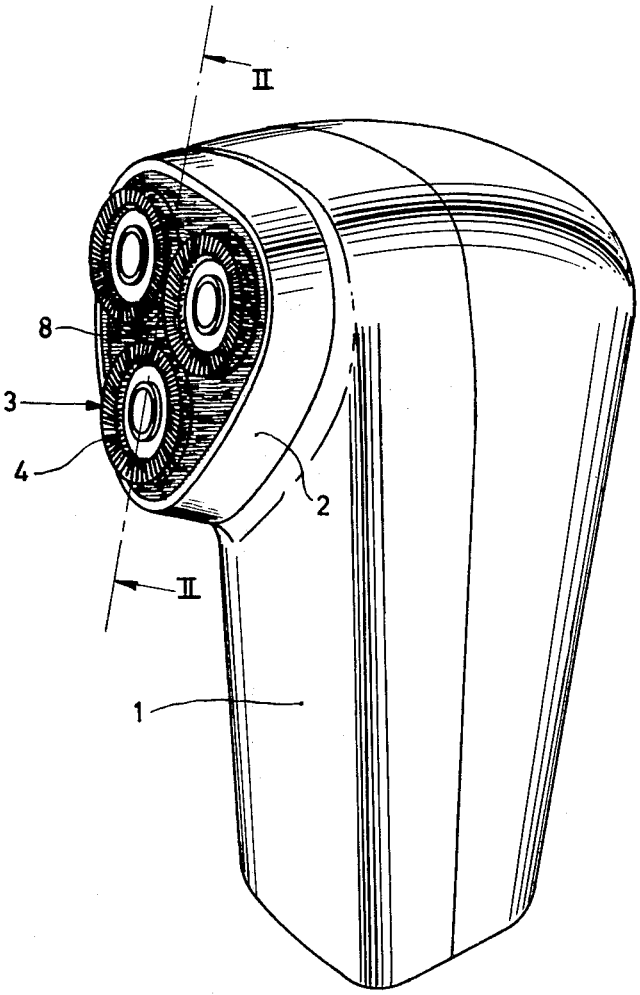
Figure 2:
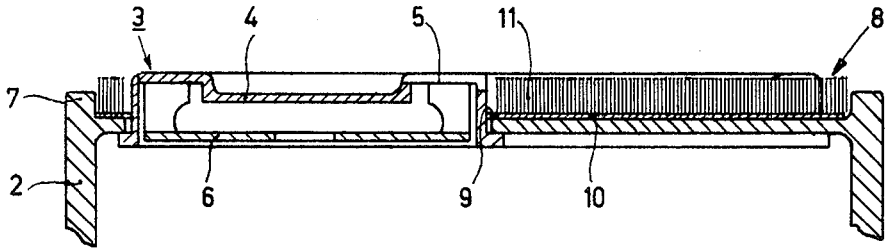
Figure 3:
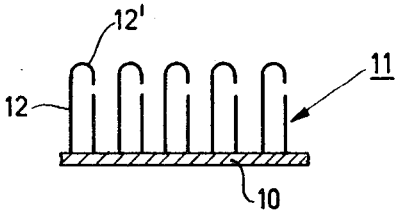
Figure 4:
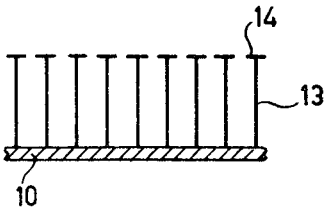
Figure 5:
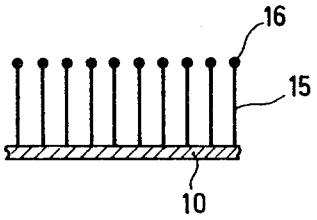
Figure 6:
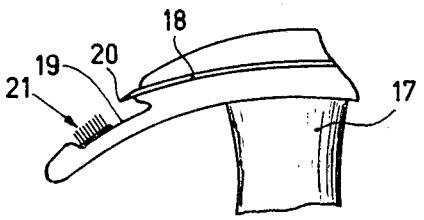

The invention will now be described in more detail with reference to the accompanying drawings, in which:

FIG. 1 is a perspective view of a shaving apparatus having three cutting units, FIG. 2 is a cross-sectional view taken on the line II—II in FIG. 1, FIGS. 3, 4 and 5, on an enlarged scale, respectively show several forms of brush bristles, and FIG. 6 is a side view of a safety razor provided with bristles in accordance with the invention.

The shaving apparatus of FIGS. 1 and 2 comprises a housing 1, of which a part takes the form of a holder 2 having a planar surface provided with apertures for three shaving heads 3 arranged in accordance with a triangular pattern. Each shaving head comprises a non-driven cutting element or shear plate 4 provided with hair-entry apertures 5 and a driven cutting element 6. The cutting element 6 can be driven relative to the shear plate 4, in known manner, by means of an electric motor, not shown, so that a hair caught in a hair-entry aperture 5 is severed by co-operation of the cutting elements 4 and 6. In order to increase the likelihood of a hair being caught in a hair entry aperture and in order to promote a satisfactory contact with the skin, a part of the cutting element 4 projects some distance above the rim 7 of the holder 2.

The holder is provided with a brush 8 for straightening the hairs. Said brush 8 comprises a mat essentially the same in area as the planar surface and is constituted by of a material known as burdock fastening strip material. Said brush is formed with three openings 9 for the shaving heads 3, so that the material is disposed around and between the shaving heads. The brush 8 then constitutes a separate component, which may for example be attached to the holder 2 by gluing.

The burdock-fastening material (FIG. 3) comprises a base 10 which is provided with loops 11. By severing or cutting away a portion one of the limbs of each loop, bristles 12 with hook-shaped ends 12' are obtained.

FIG. 4 shows bristles 13 whose hook-shaped ends are constituted by substantially T-shaped or transverse portions 14.

In the embodiment of FIG. 5 the brisles 15 are formed with hook-shaped ends in the form of thickened portions 16. These thickened portions may have various shapes and can be formed by thermal deformation of the ends of the bristles 15, in particular if the bristles are made of a plastic.

Especially if the holder 2 is formed of a plastic, the brush 8 may be integrated with the holder to form a single component.

As the shaving apparatus is passed over the skin the ends 12', 14, or 16 hook behind curled or flat hairs so that said hairs are straightened. This increases the likelihood of the hairs being caught in a hair-entry aperture 5 and being cut, which results in a more effective shaving action.

As the hairs are straightened they can be shaved off substantially transversely to their longitudinal direction. This is a considerable advantage because shaving is effected over a smaller cross-sectional area of the hair and thus demands less energy, whilst a closer shave is obtained. Moreover, in the case of an oblique position of the hair when it is cut, formation of the beard stubble which is sharply pointed is prevented. Such sharp points can readily penetrate into the skin and thus give rise to irritations etc. This problem occurs especially with persons having curly hair.

Such bristles with hook-shape ends may also be employed on other types of shaving apparatus, such as those with reciprocating cutting elements or on so-called safety razors. The last-mentioned type is shown in FIG. 6 and comprises a holder 17 to which a blade 18 is immovably secured. In a slot 19, parallel to the cutting edge 20 of the blade 18, a brush 21 having bristles with hookshaped ends are described above is fitted. The favourable effect of such a brush is also obtained in this case.

What is claimed is:

1. A shaving aparatus comprising a holder formed with a planar surface having a plurality of circular apertures; a circular shear plate positioned in each circular aperture, said shear plate being provided with hair-entrance apertures; a cutting unit associated with each shear plate and rotatable relative thereto; and a mat similar in area to that of said planar surface and having a plurality of circular openings respectively corresponding to said circular apertures, said mat being formed from a strip material provided with bristles and being attached to the planar surface and arranged thereon around and between the circular apertures, said bristles extending outwardly with respect to the planar surface and respectively having means at their outer ends for hooking and straightening hairs prior to engagement thereof by the hair-entrance apertures.

2. A shaving apparatus according to claim 1, in which the outer ends of the bristles are hook-shaped.

3. A shaving apparatus according to claim 2, in which the hook-shaped outer end of a bristle has the form of a loop, a portion of the loop having been cut away.

4. A shaving apparatus according to claim 2, in which the hook-shaped outer ends of the bristles are substantially T-shaped.

5. A shaving apparatus according to claim 1, in which the bristles are formed of a plastic, and the outer ends of the bristles have been thermally deformed.

6. A shaving apparatus according to claim 1, 2, 3, 4 or 5, in which the planar surface has three circular apertures arranged in a triangular pattern.

* * * * *